United States Patent [19]

Baillie

[11] Patent Number: 4,862,601

[45] Date of Patent: Sep. 5, 1989

[54] PARTICULATE SOLIDS DRYER WITH RECYCLED HOT-PEBBLE HEAT EXCHANGE MEDIUM

[75] Inventor: Lloyd A. Baillie, Plano, Tex.

[73] Assignee: Atlantic Richfield Company, Los Angeles, Calif.

[21] Appl. No.: 146,003

[22] Filed: Jan. 20, 1988

[51] Int. Cl.[4] ..... F26B 11/12

[52] U.S. Cl. ..... 34/182; 432/154; 432/197

[58] Field of Search ..... 110/224, 227, 228; 34/181, 182; 432/154, 182, 197

[56] References Cited

U.S. PATENT DOCUMENTS

| | | | |
|---|---|---|---|
| 3,401,923 | 9/1968 | Bearce | 432/215 X |
| 3,744,145 | 7/1973 | Maxwell et al. | 34/181 X |
| 4,094,633 | 6/1978 | Peterson et al. | 432/215 X |
| 4,474,553 | 10/1984 | Takahashi | 432/215 X |
| 4,597,737 | 7/1986 | Raghaven et al. | 432/215 X |

*Primary Examiner*—Henry A. Bennet

*Attorney, Agent, or Firm*—Michael E. Martin

[57] ABSTRACT

Particulate solids material contaminated with volatile vaporizable fluids are treated by an apparatus comprising an elongated inclined housing having a hollow conveyor screw disposed therein for rotation to move material from a lower inlet end of the housing to an upper inclined end of the housing for discharge through a bottom outlet opening. The conveyor screw is constructed from a hollow hub member having an upper open end and a lower end with a plurality of openings for conveying heat exchange pebbles or spheres from the upper end of the housing to the lower end through the interior of the hub. A combustor is disposed within the interior of the hub for generating combustion gasses which heat the conveyor screw and the heat exchange pebbles prior to entry of the pebbles into mixing with the material being conveyed through the apparatus. The pebble-material mix passes over a trammel at the outlet opening wherein the material is discharged and the pebbles are conveyed into an opening at the upper end of the conveyor screw for return to the inlet end of the housing in counterflow relationship with the combustion gasses.

9 Claims, 1 Drawing Sheet

PARTICULATE SOLIDS DRYER WITH RECYCLED HOT-PEBBLE HEAT EXCHANGE MEDIUM

BACKGROUND OF THE INVENTION

1. Field of the Invention

The present invention pertains to a particulate solids processing apparatus or dryer utilizing a hot-pebble or sphere type heat exchange medium which is recycled continuously.

2. Background

There are several instances wherein relatively large quantities of particulate solids such as earth and crushed rock contain or are "contaminated" with volatile fluids such as hydrocarbon compounds both refined and unrefined. These quantities of solids require treatment before they can be returned to the earth or other suitable means of disposal in order to decontaminate or otherwise rid the material of the volatile substances. Various types of drying apparatus have been utilized to decontaminate soils and other materials such as refinery sludges, waste streams and cuttings from drilling operations wherein hot combustion gasses are used in the drying operation to evaporate the volatile fluids. This type of treatment operation results in mixing the volatile fluids with flue gasses and requires substantially large and expensive treatment equipment.

Other problems associated with prior art drying apparatus for solids contaminated with volatile substances pertain to clogging of the drying apparatus with the solids, particularly when the presence of heavy hydrocarbon substances causes the solids to become a relatively sticky and nonflowable residue after evaporation of the more volatile fluids. These and other problems associated with prior art efforts at handling and decontaminating solids, such as earth materials and the like which have been mixed with volatile hydrocarbon fluids, have resulted in relatively complex apparatus. However, in accordance with the present invention, a substantially simplified and unique solids drying or similar treatment device has been developed which includes several advantages as will be set forth hereinbelow.

A related application of the general type of apparatus described herein pertains to extracting oil from shale or oil sands. The present invention is believed to be suitable for such applications and comprises an improvement in prior art apparatus used for retorting oil shale and oil sands.

SUMMARY OF THE INVENTION

The present invention provides an improved apparatus for drying or separating volatile fluid substances from particulate solids such as soil, rocks and thickened slurries of earth materials. In accordance with one aspect of the present invention, an apparatus is provided wherein a heat exchange medium is mixed directly with the particulate solids and which medium is in the form of heated pebbles, spheres or similar particles which are conveyed with the solids through a trough-like housing by a helical screw type conveyer from an inlet port of the housing to a discharge port. In accordance with another aspect of the invention, the heat exchange medium in the form of pebbles or sphere-like solids is recycled through an interior passage in the conveyor screw from the outlet end of the housing back to the inlet end for remixing with newly admitted material to be dried or treated.

In accordance with still further aspects of the present invention, an improved solids processing or drying apparatus is provided which utilizes heat from a combustion process and wherein combustion gasses are used to heat a flowable heat exchange medium in the form of pebbles or spheres and wherein the combustion gasses are conducted out of the apparatus without mixing with volatile vapors generated in the drying process. Heat exchange occurs both through a screw type conveyor and through the recycled heat exchanged medium. The heat exchange medium moves in a counterflow direction with respect to the combustion gasses and the heat exchange medium is circulated by a single moving part in the form of a single or double flight conveyor screw disposed within the trough-like housing of the apparatus. The conveyor screw may be advantageously designed to be essentially neutrally buoyant in the solids material being dried to minimize loading on the support bearings for the conveyor screw.

Still further aspects of the present invention reside in an apparatus wherein a combustion heating unit is disposed entirely within the part of the apparatus which heats the solids to be dried or processed directly and the heat exchange medium is not required to be handled by any apparatus which is not also directly transferring heat to the material being treated. The apparatus is also simplified by an arrangement of a housing, together with its inlet and outlet ports, which is disposed such that the volatile vapors generated during the material treatment process flow into a chamber formed in the housing which is located above the material inlet and discharge ports so that complicated vapor seal devices are not required. Means are provided for controlling the flue gas and vapor flowstreams to minimize the chance of mixing of these streams. Moreover, the apparatus is arranged in such a way that the solids to be processed are introduced to the apparatus directly in contact with the heat exchange medium so any solids which tend to agglomerate and prove difficult to move are immediately diluted or mixed with the heat exchange medium to improve the flowability of the solids material through the apparatus.

Those skilled in the art will further appreciate the advantages and features of the present invention mentioned herein together with other superior aspects thereof upon reading the detailed description which follows.

DESCRIPTION OF A PREFERRED EMBODIMENT

Figure 1:
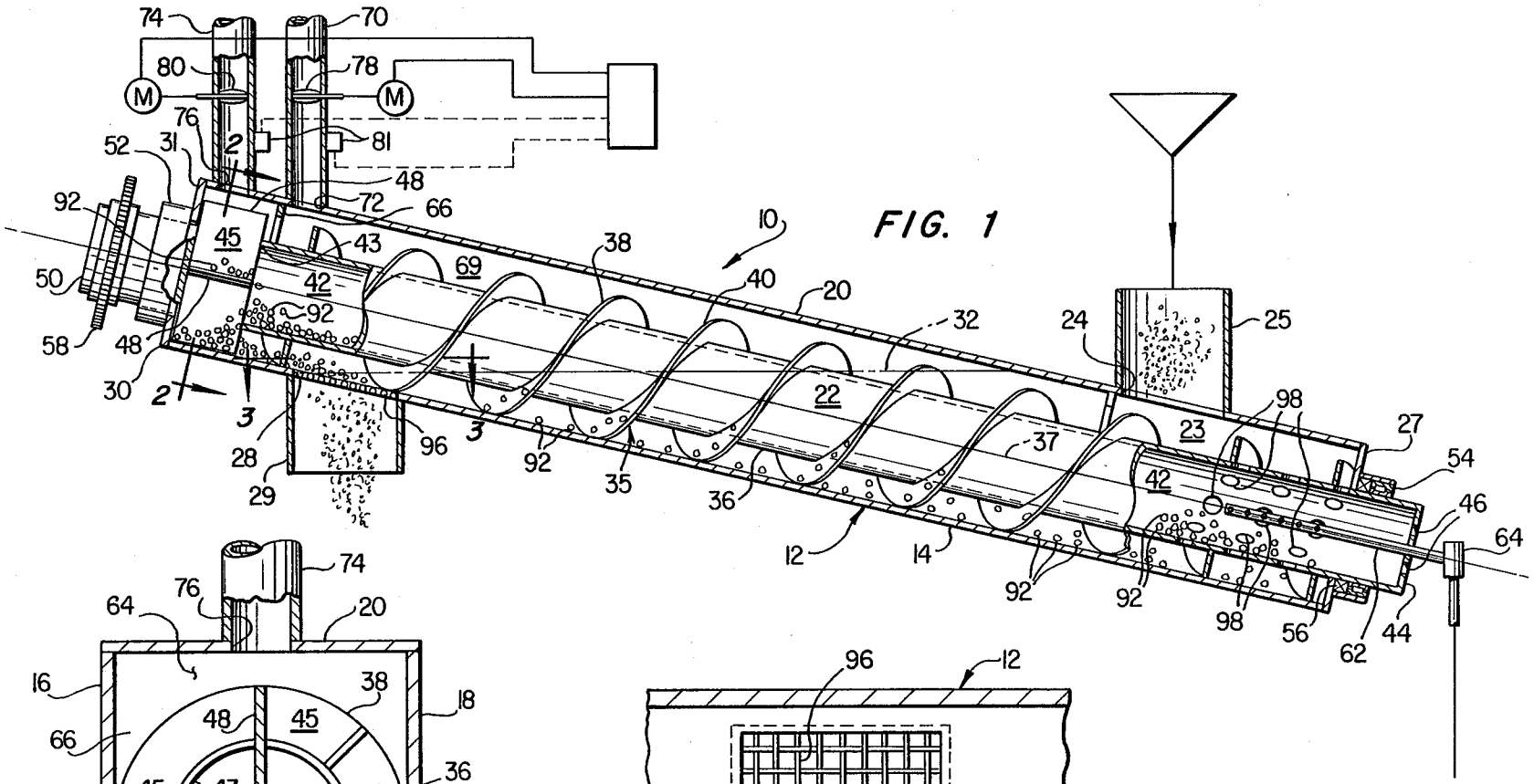
FIG. 1 is a longitudinal central section view of the improved processing or dryer apparatus of the present invention, in somewhat schematic form.

In the description which follows like parts are marked throughout the specification and drawing with the same reference numerals, respectively. The drawing figures are in somewhat schematic form and are not necessarily to scale in the interest of clarity and conciseness.

Figure 2:
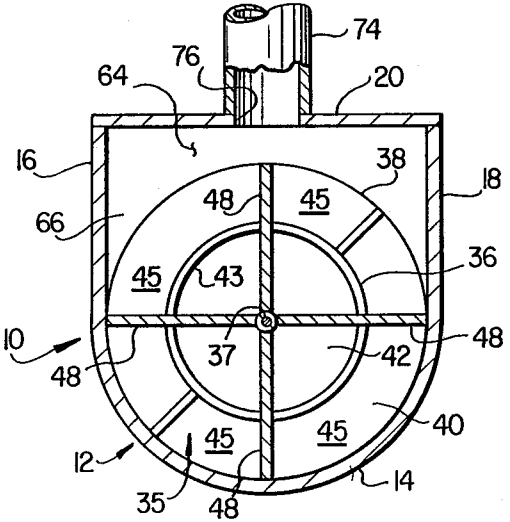
FIG. 2 is a section view taken generally along the line 2—2 of FIG. 1.

Referring to the drawing, the improved drying or processing apparatus of the present invention is generally designated by the numeral 10 and comprises an elongated inclined housing 12 having a generally semicylindrical lower portion 14 contiguous with opposed upwardly extending side walls 16 and 18, FIG. 2, and a top wall 20 defining an enclosed space 22. The housing 12 includes a material inlet port 24 disposed near the lower end 26 of the housing and opening into the interior space 22 through the top wall 20. The housing 12 also includes a material discharge port 28 located near the elevated end 30 of the housing and opening into the space 22 through the bottom portion 14. The upper edge of the port 28 is on a horizontal line 32 which is disposed above the upper edge of the inlet port 24, although the inlet and outlet ports are at substantially the same elevation. The housing 12 is closed by opposed end walls 27 and 31 at the respective lower and upper ends of the housing.

The apparatus 10 includes conveyor means extending within the space 22 comprising an elongated screw conveyor having a generally cylindrical hollow hub 36 and one or more substantially constant pitch helical conveyor flights 38 and 40 disposed around and secured to the hub 36 by conventional fabrication techniques. The hub 36 includes an interior chamber 42 which is delimited at the lower end of the hub by a transverse end wall 44 which may be formed to have a series of openings 46 therein or be formed of a foraminous material to permit the admittance of air into the chamber 42. The chamber 42 is delimited at its opposite end by an opening 43 in the hub 36 which communicates with spaces 45 formed between plural circumferentially spaced vanes 48. The vanes 48 extend radially outwardly from a central longitudinal axis 37 of the hub to be coincident with the outer diameter of the conveyor flights 38 and 40. The conveyor 35 includes a further hub portion 50 which extends through the end wall 31 and is supported by suitable bearing means 52. As illustrated in FIG. 1, the conveyor 35 is supported at its opposite end by bearing means 54 secured to the end wall 27. A suitable gas seal 56 is interposed between the bearing means 54 and the interior space 22 to prevent leakage of vapors from the space 22 out of the lower end of the housing 12. The arrangement of the bearing means 52 and a suitable seal means, not shown at the end wall 31 is similar to the arrangement of the bearing means 54 and seal 56. The conveyor 35 may be rotatably driven by drive means including a sprocket 58 secured to the hub 50 and suitably connected to a conventional drive motor and chain mechanism, not shown, for rotating the conveyor 35 in a conventional manner.

Referring further to FIG. 1, a burner pipe 62 extends within the chamber 42 adjacent the end wall 44 and is connected to a fuel flow control valve 64 in communication with a source of liquid or gaseous fuel, not shown, for feeding fuel to a combustor formed by a portion of the chamber 42 and the burner pipe. Accordingly, a fuel such as natural gas or the like may be burned in the chamber 42 adjacent the lower end thereof to generate substantial quantities of combustion gasses from oxygen fed into the chamber 42 through the foraminous end wall 44 wherein the combustion gasses heat the hub 36 and the conveyor flights 38 and 40. The combustion gasses flow upwardly through the chamber 42 and exit the chamber through the spaces formed between adjacent ones of the vanes 48 and then into a chamber 64 formed between the end wall 31 and a baffle 66 disposed within the housing and contiguous with the walls 16, 18 and 20. The baffle 66 separates the chamber 64 from a chamber 69 formed within the space 22 and generally above the line 32 wherein vapors are collected within the housing and are discharged therefrom through a flue stack 70 which opens into the space 69 through an opening 72 formed in the top wall 20.

In like manner, combustion gasses discharged from the chamber 42 into the chamber 64 are conducted out of the housing 12 through a stack 74 which opens into the chamber 64 through an opening 76 in the top wall 20. The stacks 70 and 74 may each be fitted with motorized flow control valves 78 and 80, respectively, wherein the flow of gasses from the chamber 64 and the vapors from the chamber 69 may be controlled to maintain a minimum pressure differential within the respective chambers so that there is essentially no commingling of such vapors with the combustion gasses. Suitable pressure sensors 81 may be provided for sensing the pressures in the stacks 70 and 74 upstream of the valves 78 and 80 for controlling the positions of the valves to maintain a predetermined pressure differential between the chambers 64 and 69.

Figure 3:
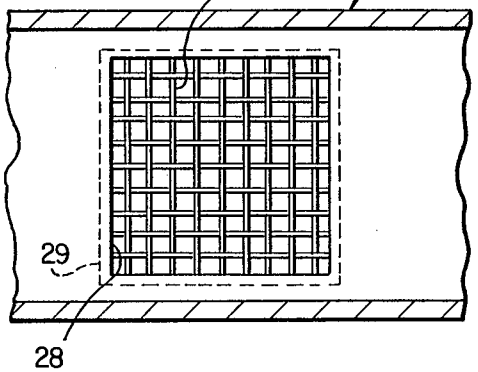
FIG. 3 is a detail section view taken generally along the line 3—3 of FIG. 1.

The apparatus 10 is provided with a quantity of heat exchange medium in the form of hard ceramic or metal pebbles or spheres 92 which are adapted to be mixed with the material introduced into the space 22 through the inlet duct 25 and conveyed with the material toward the discharge duct 29 for intimate mixing with the material to maintain its flowability and to vaporize volatile fluids which are mixed with the solids of the material. The material to be introduced into the apparatus 10 will typically have a particle size less than the particle size of the members 92 and will separate from the members 92 when the material passes over a separator screen or trammel 96, see FIG. 3, which is configured to provide openings which will not permit passage of the members 92 out of the space 22, but will permit substantially total discharge of the material being treated by the apparatus 10 through the opening 28. After separation of the material being treated from the members 92 at the trammel 96, the members 92 are conveyed further toward the end 30 of the housing 12 until they enter the spaces between the vanes 48. As the vanes 48 rotate with the conveyor 35 the members 92 are lifted upward by the vanes to a position wherein they fall into the chamber 42 and then roll and tumble downwardly toward the opposite end of the conveyor. As the members 92 move toward the lower end of the conveyor hub 36 they are exposed to openings 98 formed in the hub adjacent the flights 38 and 40 wherein the members 92 then exit the chamber 42 and return to the space 22 to mix with the material being introduced into the interior of the housing 12 in a zone 23. As the members 92 move downwardly through the chamber 42 they are exposed to the combustion gasses in a counterflow heat exchange relationship. As the members 92 exit from the chamber 42 through the openings 98, they have been substantially heated and are brought into turbulent mixing contact with the material entering the inlet zone 23 of the space 22.

Thanks to the arrangement of the hollow conveyor 36 with the helical flights 38 and 40 and the combustor formed by the fuel discharge pipe or burner 62, direct heating of the conveyor and the heat exchange medium 92 is carried out and this heat is transferred directly to the material to be treated with substantial heat exchange efficiency. Moreover, through a relatively uncomplicated mechanical device, the combustion gasses and the vapors evolving from the material being treated are maintained separate from each other. Desirable dimensional features of the apparatus include an angle of the axis 37 of about 10 degrees to 15 degrees from the horizontal. The diameter of the hub 36 is preferably about 60% of the diameter of the flights 38 and 40 and the semicylindrical housing portion 14. One advantage of the invention which may be utilized is to construct the conveyor 35 so that it is essentially neutrally buoyant in the material being treated to minimize loads on the conveyor or support bearings. For example, a double flight screw conveyor with a central hub diameter of approximately 60% of the overall diameter of the flights 38 and 40, operating to move solids having a density of about 100 pounds per cubic foot and with the system operating such that the space between the flights is approximately 33% of maximum capacity, the thickness of the metal may be derived from the equation:

$$w=0.349R$$

Where w is the steel thickness in inches and R is the radius of the screw conveyor in feet.

As discussed previously herein, the space 69 in which the vapors collect is located above the openings 24 and 28 so that volatile vapors are not likely to escape from the apparatus 10 except through the stack 70. The arrangement of the combustor formed by the pipe 62 within the chamber 42 and the counterflow arrangement of the heat exchange members 92 with respect to combustion gasses provides high efficiency heat exchange between the gasses and heat exchange medium and the material being treated. The mixing of the heat exchange members 92 with the material being treated maintains suitable flowability of the material during the treatment process that occurs as the material moves through the space 22. The apparatus may be constructed of conventional engineering materials used for high temperature applications such as encountered with rotary kilns, calciners, and similar retorting apparatus.

Although a preferred embodiment of the invention has been described in detail herein, those skilled in the art will recognize that various substitutions and modifications may be made to the apparatus without departing from the scope and spirit of the invention as recited in the appended claims.

What is claimed is:

1. Apparatus for removing volatile substances from particulate solids material such as earth contaminated with hydrocarbon liquids and the like, said apparatus comprising:

an elongated housing defining an interior space, said housing including a longitudinal central axis which is inclined with respect to the horizon, an inlet opening for receiving material to be treated in said space at a lower end of said housing and an outlet opening spaced from said inlet opening for discharging material from said space and disposed at an upper end of said housing;

an elongated conveyor screw disposed in said housing for conveying said material from said inlet opening to said outlet opening, said conveyor screw including a hollow hub defining a chamber and at least one helical conveyor flight disposed on said hub;

means for conducting combustion gasses through said chamber from a point adjacent said lower end of said housing to a point adjacent said upper end of said housing;

a quantity of heat exchange medium characterized by pebble-like solid members disposed in said housing and conveyable by said conveyor flight from said inlet opening toward said outlet opening and for mixing with material treated by said apparatus;

means adjacent an end of said conveyor screw adjacent said upper end of said housing for transferring said heat exchange medium from said space into said chamber for circulating said heat exchange medium back toward said lower end of said housing;

means in said hub for conveying said heat exchange medium from said chamber to said space for mixing with said material; and means disposed at said outlet opening for permitting material mixed with said heat exchange medium to be discharged from said space while retaining said heat exchange medium in said space for conveyance to said means for transferring said heat exchange medium from said space to said chamber whereby said heat exchange medium is continuously circulated between said space and said chamber for receiving heat from combustion gasses conducted through said chamber and for transferring said heat to said material in said space.

2. Apparatus for removing volatile substances from particulate solids material such as earth contaminated with hydrocarbon liquids and the like, said apparatus comprising:

an elongated stationary housing defining an interior space, said housing including a longitudinal central axis which is inclined with respect to the horizon, an inlet opening for receiving material to be treated in said space at a lower end of said housing and an outlet opening spaced from said inlet opening for discharging material from said space and disposed at an upper end of said housing;

an elongated conveyor screw disposed in said housing and rotatable with respect to said housing for conveying said material from said inlet opening to said outlet opening, said conveyor screw including a hollow hub defining a chamber and at least one helical conveyor flight disposed on said hub;

means for conducting combustion gasses through said chamber;

a quantity of heat exchange medium characterized by pebble-like solid members disposed in said housing and conveyable by said conveyor flight between said inlet opening and said outlet opening for mixing with material treated by said apparatus;

means for conducting said heat exchange medium from said space into said chamber for circulating said heat exchange medium back toward said inlet opening;

means in said hub for conveying said heat exchange medium from said chamber to said space for mixing with said material; and means disposed at said outlet opening for permitting material mixed with said heat exchange medium to be discharged from said space while retaining said heat exchange medium in said space for conveyance to said means for transferring said heat exchange medium from said space to said chamber whereby said heat exchange medium is circulated between said space and said chamber for receiving heat from combustion gasses conducted through said chamber and for transferring said heat to said material in said space.

3. The apparatus set forth in claim 2 wherein:

said means for transferring said members into said chamber includes a plurality of radially extending vanes for lifting said members into said chamber in response to rotation of said hub.

4. The apparatus set forth in claim 2 wherein:

said conveyor means is rotatable about an axis which is inclined with respect to the horizontal, and said space includes a chamber portion for collecting vapors and which is disposed above said inlet opening and said outlet opening, respectively.

5. The apparatus set forth in claim 4 including:

means for conveying vapors from said chamber portion of said space.

6. Apparatus for treating particulate solids to remove volatile substances therefrom comprising an elongated housing defining an interior space, said housing including an inlet opening for receiving material to be treated in said space and an outlet opening spaced from said inlet opening for discharging material from said space;

conveyor means disposed in said space and operable to convey material from said inlet opening to said outlet opening;

a heat exchange medium comprising a plurality of members movable by said conveyor means with said material to be treated;

said conveyor means including means forming a rotatable hub and at least one helical flight formed on the exterior of said hub for conveying said material to be treated and said members from said inlet opening to said outlet opening wherein said material is separated from said members, said conveyor means further including a chamber formed in said hub for conveying said members from substantially one end of said conveyor means to the other and back toward said inlet opening for remixing with material entering said space through said inlet opening;

means for generating combustion gasses within said chamber wherein said combustion gasses flow through said chamber in counterflow direction with respect to said members for heating said members as said members flow from said outlet opening toward said inlet opening, said means for generating combustion gasses including a burner apparatus disposed in said chamber adjacent one end of said hub extending toward said inlet opening;

means for introducing combustion air into said chamber at said one end of said hub; and said housing includes baffle means defining a first chamber portion for receiving combustion gasses from said hub and means for conducting said combustion gasses from said first chamber portion.

7. The apparatus set forth in claim 6 wherein:

said housing includes a second chamber portion for receiving vapor from treatment of said material and means for conducting said vapors from said second chamber portion.

8. The apparatus set forth in claim 7 including:

flow control means for controlling the flow of combustion gasses and vapor from said first and second chamber portions, respectively for maintaining a predetermined pressure differential between said chamber portions.

9. Apparatus for removing volatile substances from particulate solids material such as earth contaminated with hydrocarbon liquids and the like, said apparatus comprising:

an elongated generally cylindrical stationary housing defining an interior space, an inlet opening for receiving material to be treated in said space at one end of said housing and an outlet opening spaced from said inlet opening for discharging material from said space;

an elongated conveyor screw disposed for rotation in and relative to said housing for conveying said material from said inlet opening to said outlet opening, said conveyor screw including a hollow hub defining a chamber and at least one helical conveyor flight disposed on said hub;

means for conducting combustion gasses through said chamber;

a quantity of heat exchange medium characterized by pebble-like solid members disposed in said housing and movable by said conveyor screw between said inlet opening and said outlet opening for mixing with material treated by said apparatus;

means adjacent an end of said conveyor screw adjacent said outlet opening for transferring said heat exchange medium from said space into said chamber for circulating said heat exchange medium back toward said one end of said housing;

means in said hub for discharging said heat exchange medium from said chamber to said space for mixing with said material; and means disposed at said outlet opening for permitting material mixed with said heat exchange medium to be discharged from said space while retaining said heat exchange medium in said space for movement by said conveyor screw to said means for transferring said heat exchange medium from said space to said chamber whereby said heat exchange medium is continuously circulated between said space and said chamber for receiving heat from combustion gasses conducted through said chamber and for transferring said heat to said material in said space.

* * * * *